US005350656A

United States Patent [19]

Kouno et al.

[11] Patent Number: 5,350,656

[45] Date of Patent: Sep. 27, 1994

[54] CARRIER AND A PRODUCTION METHOD THEREOF FOR DEVELOPING AN ELECTROSTATIC IMAGE

[75] Inventors: Shigenori Kouno, Tachikawa; Ken Ohmura; Yoshiaki Koizumi, both of Hachioji; Kenji Tsujita, Fujino, all of Japan

[73] Assignee: Konica Corporation, Tokyo, Japan

[21] Appl. No.: 669,932

[22] Filed: Mar. 15, 1991

[30] Foreign Application Priority Data

Mar. 20, 1990 [JP] Japan ..... 2-68205

[51] Int. Cl.[5] ..... G03G 9/00

[52] U.S. Cl. ..... 430/108; 430/137

[58] Field of Search ..... 430/108, 137

[56] References Cited

U.S. PATENT DOCUMENTS

| | | | |
|---|---|---|---|
| 4,209,550 | 6/1980 | Hagenbach et al. | 430/108 X |
| 4,233,387 | 11/1980 | Mammino et al. | 430/137 |
| 4,342,824 | 3/1982 | Campbell | 430/108 |
| 4,788,255 | 11/1988 | Pettit et al. | 525/131 |
| 4,882,258 | 11/1989 | Ikeuchi et al. | 430/108 |
| 4,935,326 | 6/1990 | Creatura et al. | 430/108 |
| 4,966,829 | 10/1990 | Yasuda et al. | 430/109 |
| 5,075,158 | 12/1991 | Kuono et al. | 430/108 |

FOREIGN PATENT DOCUMENTS 0040804 2/1981 .

OTHER PUBLICATIONS

Patent Abstracts of Japan, vol. 8, No. 204 (P-301) (1641), Sep. 18, 1984 corresponding to JP-A-59 88749.

Patent Abstracts of Japan, vol. 13, No. 37 (P-819) (3385) Jan. 27, 1989 corresponding to JP-A-63 235959.

*Primary Examiner*—Marion E. McCamish
*Assistant Examiner*—Mark A. Chapman
*Attorney, Agent, or Firm*—Finnegan, Henderson Farabow, Garrett & Dunner

[57] ABSTRACT

There is disclosed an electrostatic image-developing carrier having a resin coat layer with an excellent mechanical strength. The carrier is prepared by repeatedly applying a mechanical impact force to the mixture of the core particle and the coating resin particle in a dry condition, wherein a molecular weight distribution chromatogram according to a gel permeation chromatography of a tetrahydro-furansoluble component in the resin coat layer has at least one peak or shoulder in a molecular weight range 1,000 to 20,000.

14 Claims, No Drawings

CARRIER AND A PRODUCTION METHOD THEREOF FOR DEVELOPING AN ELECTROSTATIC IMAGE

FIELD OF THE INVENTION

The present invention relates to a carrier and a production method thereof for developing an electrostatic image in electrophotography, electrostatic recording and electrostatic printing, and more particularly to a carrier and a production method thereof for developing an electrostatic image, wherein the carrier is prepared in a dry process by applying repeatedly a mechanical impact force to the mixture of core particles and coating resin particles to form a resin layer on the surface of core particles.

BACKGROUND OF THE INVENTION

Two-component developers used in electrophotography are generally the mixture of a toner and a carrier. The carrier is used to give an optimum amount of properly polarized triboelectricity to the toner.

A resin-coated carrier comprising a core particle and provided thereon a resin layer is preferably used to improve the durability and triboelectrification of the carrier.

A spray coating method has conventionally been used for the formation of the resin coat layer. This method, however, has the problem that it is liable to cause the flocculation of the carrier particles to make them larger, which results in lower yield of the carrier having a prescribed size distribution and a longer production time thereof.

In order to solve the above problems involved in the spray coating method, there have been proposed the following techniques for the resin coat layer formation as disclosed in:

(1) Japanese Patent Publication Open to Public Inspection (hereinafter referred to as JP O.P.I.) No. 235959/1988, in which core particles are coated in a dry condition with resin particles having a size of not more than 1/10 that of the core particles;

(2) JP O.P.I. No. 35735/1979, in which core particles is coated with resin particles in a dry condition at a higher temperature than the melting point of the resin;

(3) JP O.P.I. No. 118047/80, in which metallic core particles having the surface area of about 200 to 1300 $cm^2/g$ are heated at 160° to 343.3° C. for 20 to 120 minutes in the presence of about 0.05 to 3.0% by weight of resin particles having a size of about 0.1 to 30 μm;

(4) JP O.P.I. No. 27858/1988, in which the surfaces of core particles are coated in a dry condition with resin particles having a size of not more than 1 μm; and.

(5) JP O.P.I. No. 37360/1988, in which a fine polymer particle layer is formed and sticked on the surface of core particles.

The above techniques disclose basically that core particles and resin coating particles are mixed to allow the resin particles to stick electrostatically on the core particles by means of a triboelectricity and that mechanical impact force and/or heat are then applied to the mixture to fix the resin particles on the core particles to thereby form a resin coat layer. The sticking condition of the resin particles on the surfaces of the core particles depends substantially upon a layer forming process in which a mechanical impact force and/or heat are applied.

In the above techniques (2), (3), (4) and (5), it is difficult to obtain resin-coated carriers having a prescribed particle size distribution at a high yield because in the layer forming process the resin particles electrostatically sticked on the core particles are melted at a high temperature for fixing, which in turn is liable to cause the melted resin particles themselves to stick or the core particles to stick each other via the melted resin particles. Further, there is involved therein the problem that the resin-coated carrier surface is liable to become uneven to cause unstable triboelectrification.

The above technique (1) makes it possible to obtain resin-coated carriers having a prescribed particle size distribution at a high yield because the resin particles electrostatically sticked on the core particles are fixed mainly by means of a mechanical impact force, while it involves the problem that a coating efficiency is low and a longer production time is required.

Under such circumstances, the present inventors have proposed the technique in Japanese Patent Application No. 239180/1988, in which magnetic particles having the weight-average particle size of 10 to 200 μm and resin particles having the weight-average particle size of less than 1/200 of that of the magnetic particles are mixed uniformly in a mixing pot at 50° to 110° C. and an impact force is applied repeatedly to the mixture to thereby coat the magnetic particles with the resin. This technique, however, still has room for improving a coating efficiency and production time. That is, in the mixing process in which resin particles are electrostatically sticked on the core particles, the resin particles differ in the sticking amount and condition by an electrification of the resin particles, and the sticking density thereof becomes low due to the electrostatic repulsion between the resin particles. That makes it easy for the coating resin particles to transfer between the core particles and requires longer time to form a uniform resin coat layer in the layer-forming process in which the coating resin particles are fixed on the core particles.

Thus, the coating resin particles are mixed with the core particles in such a manner that they are sticked densely on the core particles and then a mechanical impact force is applied to the mixture while heating if necessary to minutely dispose the resin particles on the core particles and fix them, whereby a resin coat layer is formed. In performing simultaneously disposition and fixation of the resin particles, it is liable to take a long time to form an even resin coat layer. Further, there is involved the difficulty that the resin particles sticking on the core particles drop therefrom to lower the resin coating efficiency while a mechanical impact force is applied. The dropped resin particles are liable to stick each other to form larger particles, which make it difficult for themselves to stick on the core particles because of their poor ductility. In addition, the dropped resin particles are liable to adversely affect the electrophotographic characteristics of copied images.

Under such circumstances, there have been proposed the technique in which the surfaces of the core particles are treated to control the electrostatic friction therebetween to thereby increase the electrostatic cohesion of the core particles and the resin particles, as disclosed in Japanese Patent Applications No. 314158/1988 and 314159/1988; and the technique in which the addition of coating resin particles is controlled to improve the electrostatic friction between the core and resin particles, as disclosed in Japanese Patent Applications No. 79306/1989 and 79312/1989. These techniques, however, still require a longer production time and can not necessarily provide satisfactory resin-coated carriers.

SUMMARY OF THE INVENTION

It is an object of the present invention to provide a resin-coated carrier having a uniform resin coat layer with a high mechanical strength.

It is another object of the invention to provide the method for preparing an electrostatic image-developing carrier, by which the resin-coated carrier having a uniform resin coat layer with a high mechanical strength can be efficiently produced in a shorter time without causing dropping and flocculation of the resin particles.

The above objects can be achieved by the electrostatic image-developing carrier comprising a core particle and a resin coat layer provided thereon by repeatedly applying a mechanical impact force to the mixture of the core particle and the coating resin particle in a dry condition, wherein a molecular weight distribution chromatogram according to a gel permeation chromatography (GPC) of a tetrahydrofuran (THF)-soluble component in the resin coat layer has at least one peak or shoulder in the molecular weight range of 1,000 to 20,000.

DETAILED DESCRIPTION OF THE INVENTION

The area present in the molecular weight range of 1,000 to 20,000 in the above chromatogram accounts preferably for 5 to 65% of the whole chromatogram area.

The coating resin particles comprise preferably the copolymer consisting of at least one of methacrylate type monomers and at least one of a styrene type monomer and an acrylate type monomer.

In the invention, the core particles and the coating resin particles are stirred for mixing under such a stirring condition that molecular chains of the resin constituting the resin particles are cut, to thereby prepare in a short time the carrier in which the resin particles are aligned regularly and fixed uniformly in minute layers on the core particles by the effective action of a mechanochemical effect.

The molecular weight was measured by the GPC method in the following manner: 3 mg of the sample having the concentration of 0.2 g/20 ml were injected into a gel column and spread by flowing THF at the rate of 1.2 ml/min at 40° C., wherein the molecular weight distribution of the sample was calculated from the log value-count number relation of the calibration curve prepared from the several reference samples of monodispersed polystyrene. The reliability of the measured results was confirmed by the fact that the weight-average molecular weight and number-average molecular weight of NBS 706 polystyrene reference sample were 288,000 and 137,000, respectively. The examples of the GPC column is TSK-GEL and GMH manufactured by Toyo Soda Co.

The peaks or shoulders present in the molecular weight range of 1,000 to 20,000 in the chromatogram mean that the molecular chains of the coating resin particles are severed to generate low-molecular components. Such low-molecular components are considered to contribute to the regular alignment of the resin particles on the core particles and the uniform fixation thereof in a minute layer in the mixing process. The molecular weight of the coating resin particles prior to mixing can be compared with that of the obtained resin coat layer to confirm the degradation of the molecular weight caused by cutting of the molecular chains.

In the mixing process, it is necessary to apply a mechanical impact force capable of severing the molecular chains to effectively exert a mechanochemical effect. It is also possible to replace the coating resin particles with ones originally containing low-molecular components and to apply a mechanical impact force to them as well to thereby form a uniform resin coat layer having a large mechanical strength.

The severance of the molecular chains scarcely depends on the molecular weights of the resin particles but primarily on a temperature and a stirring speed and time, each of which can be optimized for the efficient severance of the molecular chains.

From this point of view, it is preferable that the mixing process and the resin layer formation process are carried out separately at the different conditions. The temperature in the mixing process is set preferably lower than the glass transition point Tg of the resin particles in order to stick satisfactorily the resin particles on the core particles.

Further, the area present in the molecular weight range of 1,000 to 20,000 in the GPC chromatogram accounts preferably for 5 to 65% of the whole chromatogram area. The too small area would prevent a mechanochemical effect from acting effectively, while too large one would lower the mechanical strength of the resin coat layer.

The equipment for producing the carrier of the invention is preferably a high-speed stirring mixer, particularly of a horizontal stirring type. A vertical stirring-type mixer is not preferable because it is liable to destroy the core particles by overloaded impact force given to stir up vertically the core particles.

The amount of the coating resin particles is 0.1 to 10 parts by weight, preferably 0.5 to 4 parts by weight per 100 parts by weight of the core particles.

The coating resin particles may be either non-porous primary resin particles, or porous secondary resin particles consisting of primary resin particles. The primary particles are defined by that the individual particles are separated.

The non-porous primary resin particles have preferably a volume-average particle size of 0.001 to 1.0 μm and a BET specific surface area of 40 to 6000 $m^2/g$.

The porous secondary resin particles have a volume-average particle size of 1.5 to 5.0 μm and a BET specific surface area of 5 to 6000 $m^2/g$, preferably 10 to 300 $m^2/g$ and more preferably 20 to 150 $m^2/g$. The secondary resin particles comprise preferably primary resin particles which have a volume-average particle size of not more than 0.5 μm and stick each other on the molten surfaces.

The BET specific surface area of the coating resin particles was measured with a micromeritics flow sorb II 2300 manufactured by Shimadzu Mfg. Co.

The volume-average particle size of the coating resin particles was measured with a laser diffraction granularity distribution meter HEROS manufactured by Nippon Electron Co. after the coating resin particles were dispersed in a 500 cc beaker containing a surfactant and water for 2 minutes with a 150 W ultrasonic homogenizer.

The resin materials for the coating resin particles can be broadly selected, because the treatment in the invention is carried out in a dry process, so that even the resins insoluble or scarcely soluble in solvents can be used. The examples thereof are styrene resins, acryl resins, styrene-acryl resins, vinyl resins, ethylene resins, rosin-modified resins, polyamide resins, polyester resins, silicone resins, and fluorinated resins. These resins may be used in combination.

Particularly preferred in the invention are the coating resin particles comprising at least one of methacrylate monomers, a styrene monomer and/or an acrylate monomer.

The above methacrylate monomers should preferably include methyl methacrylate as an essential monomer.

Examples of the methacrylate monomers are methyl methacrylate, butyl methacrylate, octyl methacrylate, and lauryl methacrylate.

Examples of the styrene monomers are styrene, m-methyl styrene, α-methyl styrene, and 2,4-dimethyl styrene.

Examples of the acrylate monomers are acrylic acid, methyl acrylate, butyl acrylate, and octyl acrylate.

The above monomers may be used in combination.

Further, in the preferred embodiment, the above copolymer comprises essentially methyl methacrylate, and the methacrylate monomers account preferably for 30 to 90% by weight of the copolymer. The excessive methacrylate monomers are liable to lower the mechanical strength of the resin coat layer, while the too small amounts are apt to result in poorer layer formability by resin particles; particularly, the adherence thereof to the core particles is liable to deteriorate to result in cracks or peeling of the resin coat layer.

The core particles are preferably magnetic particles. The magnetic particles preferably have a weight-average particle size of 10 to 200 μm in view of the triboelectrification thereof with a toner and the adherence of the carrier to a photoreceptor. The weight-average particle size was measured with a microtrack Type 7981-OX manufactured by Leads & Northrup Co.

The core particles preferably have a substantially spherical form, and the sphericity thereof is preferably not less than 0.7. Such substantially spherical core particles can provide spherical carriers and give them more fluidity, which makes it possible to stably transport an optimum amount of toners to a developing unit, whereby a steady operation can be maintained.

The sphericity is defined by the following equation:

$$\text{Sphericity} = \left[\frac{\text{Circumference of a circle having the same area as that of a projected particle}}{\text{Contour length of a projected particle}}\right]^2$$

The sphericity can be measured with an image analyzer manufactured by Nippon Avionics Co.

The examples of the materials for the magnetic particles are ferromagnetic metals such as iron, cobalt and nickel, alloys and compounds containing these metals.

EXAMPLES

The present invention is explained in detail by referring to the examples, wherein parts mean parts by weight.

Example 1

The following components put in a high-speed stirring mixer were mixed for 20 minutes under the conditions of a processing temperature of not higher than 42° C. (lower than Tg: 62° C.) and a stirrer's circumferential speed of 5.2 m/sec. Then, the stirrer speed was increased to 8.4 m/sec. and the temperature was raised to 60° C. to further continue the stirring for 40 minutes to thereby repeatedly apply a mechanical impact force to the materials. Thus, the resin-coated carrier Sample No. 1 was prepared.

| | |
|---|---|
| Core particles (spherical ferrite powder, volume-average particle size: 40 μm) | 100 parts |
| Coating resin particles | 2.5 parts |

(a MMA/BA copolymer, wherein MMA is methyl methacrylate and BA is butyl acrylate; the chromatogram of THF-soluble components according to GPC has neither peaks nor shoulders in the molecular weight range of 1,000 to 20,000; Tg: 62° C.; and a volume-average particle size: 0.10 μm.)

The resin coat layer of the above carrier had at least one peak or shoulder in the molecular weight range of 1,000 to 20,000 in the chromatogram of THF-soluble components according to GPC, and the area existing in the molecular weight range of 1,000 to 20,000 accounted for 55% of the whole chromatogram area.

Samples No. 2 to 14 were prepared in the same manner as in Sample No. 1, provided that the core particles, the coating resin particles and the processing conditions were changed as shown in Table 1.

The resin coat layers of inventive Samples No. 2 to 8 had at least one peak or shoulder in the molecular weight range of 1,000 to 20,000 in the chromatogram, but those of comparative Samples No. 9 to 14 had no such peaks or shoulders.

Example 2

The respective carrier samples prepared in Example 1 were mixed with the optimum toners to prepare the developer Samples No. 1 to 14, each of which was subjected to copying test to evaluate an initial fog and a durability.

Of the developing conditions, the photoreceptor-developing sleeve distance $D_{sd}$ and the doctor blade-developing sleeve distance Hcut were controlled to the optimum levels according to the particle size of each carrier.

TABLE 1

| Sample No. | Core particles Kind | Core particles Size*1 (μm) | Resin coat particles Composition | Tg (°C.) | Size*1 (μm) | BET*2 ($m^2/g$) | Amount*3 (part) |
|---|---|---|---|---|---|---|---|
| 1 (Inv.) | Ferrite | 40 | MMA/BA | 62 | 0.10 | — | 2.5 |
| 2 (Inv.) | Ferrite | 120 | MMA/BA | 62 | 0.10 | — | 1.3 |
| 4 (Inv.) | Ferrite | 40 | MMA/BA*5 | 62 | 2.94 | 59 | 2.5 |

TABLE 1-continued

| | | | | | | | |
|---|---|---|---|---|---|---|---|
| 5 (Inv.) | Ferrite | 80 | MMA/BA*5 | 62 | 2.94 | 59 | 1.5 |
| 6 (Inv.) | Ferrite | 120 | MMA/BA*5 | 62 | 2.94 | 59 | 1.3 |
| 7 (Inv.) | Ferrite | 80 | MMA/BA*6 | 74 | 2.57 | 83 | 1.5 |
| 9 (Comp.) | Ferrite | 40 | MMA/BA | 62 | 0.10 | — | 2.5 |
| 10 (Comp.) | Ferrite | 40 | MMA/BA | 62 | 0.10 | — | 2.5 |
| 13 (Comp.) | Ferrite | 80 | MMA/BA/ST | 74 | 0.08 | — | 1.5 |
| 14 (Comp.) | Ferrite | 40 | MMA/BA/ST | 74 | 0.08 | — | 2.5 |

| | Mixing process | | | Layer forming process | | | |
|---|---|---|---|---|---|---|---|
| Sample No. | Speed (m/s) | Temperature (°C.) | Time (min) | Speed (m/s) | Temp. (°C.) | Time (min) | Area*4 ratio (%) |
| 1 (Inv.) | 5.2 | 42 or lower | 20 | 8.4 | 60 | 40 | 55 |
| 2 (Inv.) | 4.2 | 45 or lower | 15 | 8.4 | 67 | 20 | 44 |
| 4 (Inv.) | 5.2 | 46 or lower | 20 | 12.6 | 85 | 30 | 10 |
| 5 (Inv.) | 5.8 | 49 or lower | 15 | 5.8 | 85 | 30 | 5 |
| 6 (Inv.) | 5.8 | 58 or lower | 15 | 12.6 | 58 | 40 | 32 |
| 7 (Inv.) | 4.2 | 42 or lower | 15 | 10.5 | 96 | 20 | 16 |
| 9 (Comp.) | 5.2 | 40 or lower | 20 | 14.7 | 58 | 40 | 70 |
| 10 (Comp.) | 4.2 | 45 or lower | 30 | 8.4 | 82 | 20 | 3 |
| 13 (Comp.) | 3.2 | 36 or lower | 20 | 4.2 | 98 | 40 | 4 |
| 14 (Comp.) | 3.2 | 30 or lower | 20 | 4.2 | 92 | 40 | 0 |

*1: volume-average particle size
*2: BET specific surface area
*3: an amount per 100 parts of the core particles
*4: the ratio of the area in the molecular weight range of 1,000 to 20,000 in the GPC chromatogram
*5 & *6: porous secondary resin particles consisting of primary resin particles of MMA/BA copolymer The durability is shown in terms of the number of copies in which the image density (Dmax) copied from the original density of 1.3 has been decreased to the level of lower than 1.0, or the density (fog) on a white background exceeds 0.02, provided that the image density was observed every 5000 copies. The results are shown in Table 2.

TABLE 2

| Sample No. | Initial Fog | Durability |
|---|---|---|
| 1 (Inv.) | None | More than 40,000 copies |
| 2 (Inv.) | None | More than 150,000 copies |
| 4 (Inv.) | None | More than 40,000 copies |
| 5 (Inv.) | None | More than 150,000 copies |
| 6 (Inv.) | None | More than 150,000 copies |
| 7 (Inv.) | None | More than 150,000 copies |
| 9 (Comp.) | None | Up to 20,000 copies |
| 10 (Comp.) | Much | Up to 30,000 copies |
| 13 (Comp.) | Much | Up to 100,000 copies |
| 14 (Comp.) | Much | Up to 20,000 copies |

As is apparent from Table 2, the carriers of the invention are more excellent in the copying properties than the comparative carriers. The resin coat layers of the inventive carriers are uniform and have high mechanical strengths. In addition, no aggregated coating resin particles are included therein, so that no developing troubles such as fog and insufficient image density are caused in the initial developing stage.

What is claimed is:

1. An electrostatic image-developing carrier comprising a ferrite core particle and a resin coat layer provided thereon by applying repeatedly a mechanical impact force to the mixture of the ferrite core particle and a single type of coating resin particle in a dry condition, wherein the ferrite core particle and the coating resin particle are mixed at a temperature less than the glass transition point of the resin particles for time less than or equal to 20 minutes and wherein the temperature of the resin layer-forming process is less than or equal to about 97° C. and the stirring speed of the resin layer-forming process is 5.8 to 12.6 m/sec, and wherein a molecular weight distribution chromatogram according to a gel permeation chromatography of a tetrahydrofuran-soluble component in the resin coat layer has at least one peak or shoulder in a molecular weight range of 1,000 to 20,000 and said peak or shoulder accounts for 5 to 65% of the area of the chromatogram.

2. The carrier of claim 1, wherein the coating resin particle comprises a non-porous primary resin particle or a porous resin particle consisting of a primary resin particle.

3. The carrier of claim 2, wherein the non-porous primary resin particle has a volume-average particle size of 0.001 to 1.0 μm and a BET specific surface area of 40 to 6000 $m^2/g$.

4. The carrier of claim 2, wherein the porous secondary resin particle has a volume-average particle size of 1.5 to 5.0 μm and a BET specific surface area of 5 to 600 $m^2/g$.

5. The carrier of claim 1, wherein the coating resin particle comprises at least one methacrylate monomer and at least one styrene monomer and acrylate monomer.

6. The carrier of claim 5, wherein at least one of the methacrylate monomers is methyl methacrylate.

7. The carrier of claim 1, wherein the resin coat layer is formed without melting of the core or coating particles.

8. The carrier of claim 1, wherein the resin coat layer is formed at a temperature of 58° to 97° C.

9. The electrostatic image-developing carrier of claim 1, wherein said single type of coating resin is a copolymer, wherein said coating resin comprises methyl methacrylate and methacrylate monomers and account for 30 to 90% by weight of said copolymer.

10. A method of preparing an electrostatic image-developing carrier comprising a core particle and provided thereon a resin coat layer, comprising:

a mixing process in which the ferrite core particle and a single type of coating resin particle are mixed at a temperature less than the glass transition point of the resin particles for a time less than or equal to 20 minutes, and a resin layer-forming process in which a mechanical impact force is repeatedly applied to the mixture of the core particle and a single type of coating resin particle in a dry condition to form the resin coat layer on the core particle, at a temperature of less than or equal to about 97° C. and a stirring speed of 5.8 to 12.6 m/sec, wherein a molecular weight distribution chromatogram according to gel permeation chromatography of a tetrahydrofuran-soluble component in the resin coat layer has at least one peak or shoulder in a molecular weight range of 1,000 to 20,000 and said peak or shoulder accounts for 5 to 65% of the area of the chromatogram.

11. The method of claim 10, wherein a molecular chain of the coating resin is cut in the mixing process to form a lower molecular weight resin.

12. The method of claim 10, wherein the layer-forming process occurs without melting of the core or coating particles.

13. The method of claim 10, wherein the temperature of the resin layer-forming process is 58° to 98° C.

14. The method of claim 10, wherein said single type of coating resin is a copolymer, wherein said coating resin comprises methyl methacrylate and methacrylate monomers and account for 30 to 90% by weight of said copolymer.

* * * * *

UNITED STATES PATENT AND TRADEMARK OFFICE

CERTIFICATE OF CORRECTION

PATENT NO. : 5,350,656

DATED : September 27, 1994

INVENTOR(S) : Shigenori KOUNO et al.

It is certified that error appears in the above-indentified patent and that said Letters Patent is hereby corrected as shown below:

Claim 13, column 10, line 22 change "98°" to --97°--.

Signed and Sealed this

Twenty-fifth Day of April, 1995

*Attest:*

Bruce Lehman

BRUCE LEHMAN

*Attesting Officer*

*Commissioner of Patents and Trademarks*